US008882428B2

(12) United States Patent
Fikes et al.

(10) Patent No.: US 8,882,428 B2
(45) Date of Patent: Nov. 11, 2014

(54) PROPPANT TRANSFER SYSTEM

(75) Inventors: Mark Fikes, Marlow, OK (US); John Gilbert Heaton, Duncan, OK (US); Herbert John Horinek, Duncan, OK (US); Ed Bryan Hagan, Hastings, OK (US); Robert Douglas Hayworth, Chickasha, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 500 days.

(21) Appl. No.: 12/951,257

(22) Filed: Nov. 22, 2010

(65) Prior Publication Data

US 2012/0128449 A1 May 24, 2012

(51) Int. Cl.

| | |
|---|---|
| ***B63B 27/30*** | (2006.01) |
| ***B66C 23/52*** | (2006.01) |
| ***B65G 67/60*** | (2006.01) |
| ***B67C 3/26*** | (2006.01) |
| ***B63B 27/34*** | (2006.01) |
| ***B63B 27/25*** | (2006.01) |

(52) U.S. Cl.

CPC ..... *B63B 27/34* (2013.01); *B63B 27/25* (2013.01)

USPC ..... 414/138.2; 141/284; 414/142.2; 137/615

(58) Field of Classification Search

USPC ..... 137/615; 141/279; 198/544, 594; 406/197, 38, 115, 167; 414/137.1, 414/137.5, 137.8, 137.9, 138.4, 138.5, 414/138.6, 138.7, 138.9, 139.1, 139.3, 414/139.4, 140.5, 140.7, 140.9, 414/141.3–141.5, 141.9, 142.1, 142.2, 414/142.7, 143.1, 143.2

See application file for complete search history.

(56) References Cited

U.S. PATENT DOCUMENTS

| | | | | | |
|---|---|---|---|---|---|
| 607,255 | A | * | 7/1898 | Marangos | 198/518 |
| 650,719 | A | * | 5/1900 | Haviland, et al. | 406/169 |
| 975,312 | A | * | 11/1910 | Anderson | 414/138.2 |
| 1,112,647 | A | * | 10/1914 | Outterson | 406/38 |
| 1,680,831 | A | * | 8/1928 | White | 137/615 |
| 1,942,839 | A | * | 1/1934 | Sheal et al. | 414/142.4 |
| 2,942,740 | A | * | 6/1960 | Pristach | 414/138.4 |
| 3,032,082 | A | * | 5/1962 | Vilain | 141/388 |
| 3,146,898 | A | * | 9/1964 | Kersting | 414/140.9 |

(Continued)

OTHER PUBLICATIONS

MacGregor: Nordstroms dry bulk handling systems for sypply vessels—available at http://www.macgregor-group.com/?id=11811 &tid=print, 2 pages, last visited Sep. 15, 2010.

(Continued)

*Primary Examiner* — Gregory Adams

(74) *Attorney, Agent, or Firm* — McDermott Will & Emery LLP; John W. Wustenberg

(57) ABSTRACT

A transfer system includes a conduit, a support, and a conveyor. The conduit has a first end and a second end and is configured to transfer dry material from the first end to the second end. The support is in contact with at least a portion of the conduit and is configured to maintain the second end of the conduit in a desired position relative to the first end of the conduit during transfer of the dry material from the first end to the second end. The conveyor is adjacent to the conduit and is configured to deliver the dry material to the first end of the conduit from a floating vessel configured to transport the dry material.

7 Claims, 6 Drawing Sheets

(56) References Cited

U.S. PATENT DOCUMENTS

| | | | | | |
|---|---|---|---|---|---|
| 3,199,553 | A | * | 8/1965 | Garrett et al. | 141/388 |
| 3,273,942 | A | * | 9/1966 | McFarland | 406/115 |
| 3,598,224 | A | * | 8/1971 | Oury | 198/301 |
| 3,746,060 | A | * | 7/1973 | Janssen et al. | 141/387 |
| 3,836,019 | A | * | 9/1974 | Aralt | 414/141.5 |
| 3,881,530 | A | * | 5/1975 | Faldi | 141/284 |
| 3,884,528 | A | * | 5/1975 | Shaddock | 406/115 |
| 3,921,557 | A | * | 11/1975 | Kapteijn et al. | 114/256 |
| 3,945,484 | A | * | 3/1976 | Oury | 198/313 |
| 4,019,641 | A | * | 4/1977 | Merz | 406/116 |
| 4,408,943 | A | * | 10/1983 | McTamaney et al. | 137/899.2 |
| 4,475,848 | A | * | 10/1984 | Truninger | 406/115 |
| 4,609,309 | A | * | 9/1986 | Aralt | 406/56 |
| 4,971,482 | A | | 11/1990 | Kjorling | |
| 5,498,119 | A | * | 3/1996 | Faivre | 414/528 |

OTHER PUBLICATIONS

MacGregor: Nordstroms high-volume bulk-handling solutions—available at http://www.macgregor-group.com/?id=11761&tid=pring, 1 page, last visited Sep. 15, 2010.

* cited by examiner

PROPPANT TRANSFER SYSTEM

BACKGROUND

The present invention relates to equipment and methods useful in transfer of materials, and more particularly, to transfer of dry materials from a floating vessel to a second vessel.

When doing a stimulation job at sea, a single, specialized vessel is typically used to both transport materials to the site, and conduct stimulation operations. Thus, when a stimulation vessel completes a job and leaves a rig, it frequently must go back to shore to fill up with materials before proceeding to the next rig. In large operations, a stimulation vessel may lack sufficient storage to complete the job without refilling with proppant. Thus, larger stimulation vessels may be used at an increased cost. Alternatively, additional stimulation vessels may be used to ensure limited downtime while waiting for any particular stimulation vessel to complete a trip to shore.

SUMMARY

The present invention relates to equipment and methods useful in transfer of materials, and more particularly, to transfer of dry materials from a floating vessel to a second vessel.

In one embodiment, a transfer system includes a conduit, a support, and a conveyor. The conduit has a first end and a second end and is configured to transfer dry material from the first end to the second end. The support is in contact with at least a portion of the conduit and is configured to maintain the second end of the conduit in a desired position relative to the first end of the conduit during transfer of the dry material from the first end to the second end. The conveyor is adjacent to the conduit and is configured to deliver the dry material to the first end of the conduit from a floating vessel configured to transport the dry material.

In another embodiment, a transfer system includes a workboat, a conduit, a support and a conveyor. The conduit has a first end and a second end, and is configured to transfer dry material from the first end to the second end. The first end is configured for placement proximate the workboat, and the second end is configured for placement remote from the workboat. The support is in contact with at least a portion of the conduit. The support is configured to maintain the second end of the conduit in a desired position relative to the first end of the conduit during transfer of the dry material from the workboat via the conduit. The conveyor is adjacent the conduit and is configured to deliver the dry material to the first end of the conduit from a container configured to store the dry material on the workboat.

In another embodiment, a method of transferring dry material includes providing a transfer system, transferring the dry material from a floating vessel via a conveyor to a first end of a conduit, and allowing the conduit to transfer the dry material from the first end to a second end of the conduit. The transfer system includes the conduit, a support, and the conveyor. The conduit has the first end and the second end and is configured to transfer the dry material from the first end to the second end. The support is in contact with at least a portion of the conduit. The support is configured to maintain the second end of the conduit in a desired position relative to the first end of the conduit during transfer of the dry material from the first end to the second end. The conveyor is adjacent the conduit. The conveyor is configured to deliver the dry material to the first end of the conduit from the floating vessel, which is configured to transport the dry material.

The features and advantages of the present invention will be readily apparent to those skilled in the art. While numerous changes may be made by those skilled in the art, such changes are within the spirit of the invention.

BRIEF DESCRIPTION OF DRAWINGS

These drawings illustrate certain aspects of some embodiments of the present invention, and should not be used to limit or define the invention.

Figure 1:
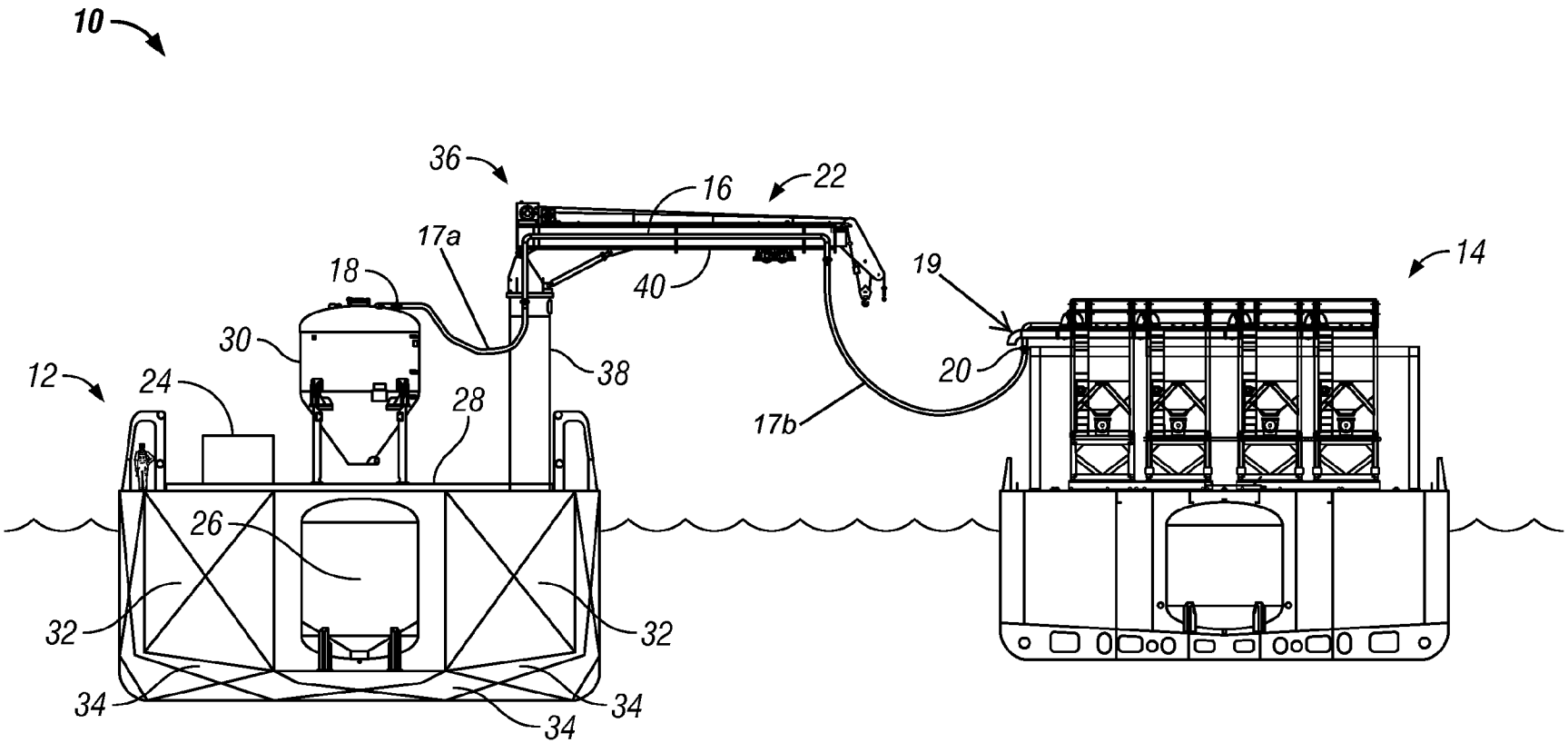
FIG. 1 is a cross-sectional side view of a transfer system, in accordance with one embodiment of the present invention.

While the present invention is susceptible to various modifications and alternative forms, a specific exemplary embodiment thereof has been shown by way of example in the drawings and is herein described in detail. It should be understood, however, that the description herein of specific embodiments is not intended to limit the invention to the particular form disclosed, but on the contrary, the intention is to cover all modifications, equivalents, and alternatives falling within the spirit and scope of the invention as defined by the appended claims.

DETAILED DESCRIPTION

The present invention relates to equipment and methods useful in transfer of materials, and more particularly, to transfer of dry materials from a floating vessel to a second vessel. In some embodiments, a workboat or other non-specialized boat can store and transport dry materials from shore to a stimulation vessel, reducing downtime associated with the stimulation vessel returning to shore for a refill.

Figure 2:
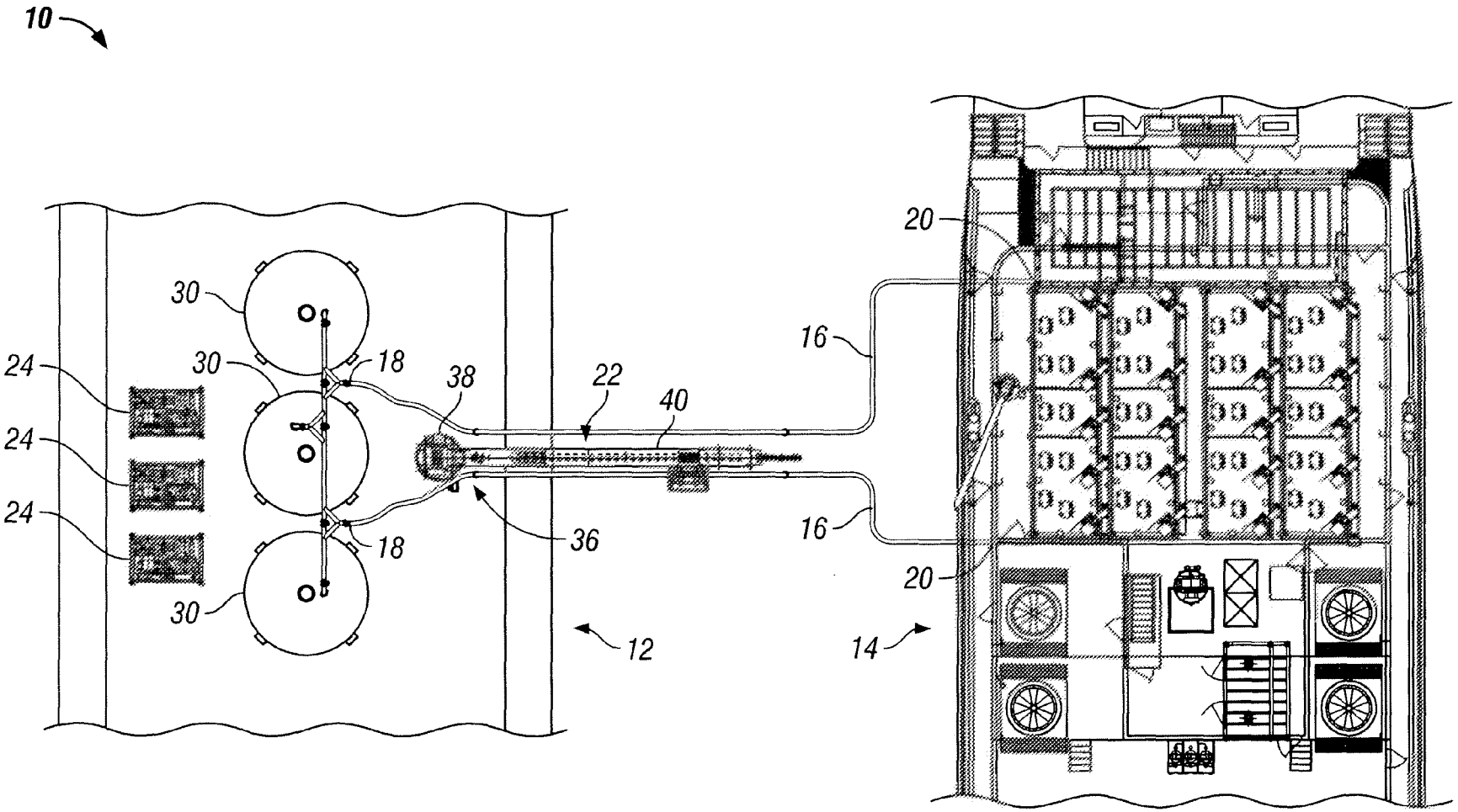
FIG. 2 is a top view of the transfer system of FIG. 1.

Referring to FIGS. 1 and 2, transfer system 10 may be used to transfer powders, solids, and/or other dry materials from a marine workboat (e.g., offshore supply vessel, platform supply vessel, etc.) or other floating vessel 12 to a platform, well stimulation vessel, jack up rig, drilling vessel, or other second vessel 14 while at sea. Transfer system 10 may have at least one conduit 16 having first end 18 and second end 20, configured to transfer dry material (e.g., cements, drilling muds, dry gels, dry chemical used in acidizing, or proppants such as naturally occurring sand, resin-coated sand, high-strength ceramic materials like sintered bauxite, or other types of proppant such as guar) therethrough. Transfer system 10 may also have support 22 in contact with at least a portion of conduit 16, and configured to maintain second end 20 of conduit 16 in a desired position (e.g., at a substantially same elevation, lower elevation, or marginally higher elevation) relative to first end 18 during transfer of dry material from first end 18 to second end 20. Transfer system 10 may also have conveyor 24 adjacent conduit 16 and configured to deliver dry material to first end 18 of conduit 16.

Floating vessel 12 may include a number of containers, receptacles, or other spaces for storage of various materials during transport to second vessel 14. For example, as indicated in FIGS. 1 and 2, floating vessel 12 may include dry bulk 26 below deck 28 and/or bulk tank 30 above deck 28. Floating vessel 12 may also include liquid mud tank 32, rig water tank 34 below deck 28. While FIGS. 1 and 2 illustrate certain storage above and other storage below deck 28, various other configurations may be desirable.

Second vessel 14 may include hydraulic fracturing equipment, acidizing equipment, cementing equipment, etc.

Transfer system 10, including conduit 16, support 22, and conveyor 24, may be transported to second vessel 14 by floating vessel 12. Such transport may be done with transfer system 10 in place and ready for operations, or transport may occur with transfer system 10 partially or wholly unassembled. Generally, transfer system 10 allows for materials, such as dry material to be moved from storage on floating vessel 12 to a desired location on second vessel 14. Dry material may move from dry bulk 26 to bulk tank 30 to first end 18 of conduit 16, through conduit 16 and out second end 20 onto or into second vessel 14.

Figure 3A:
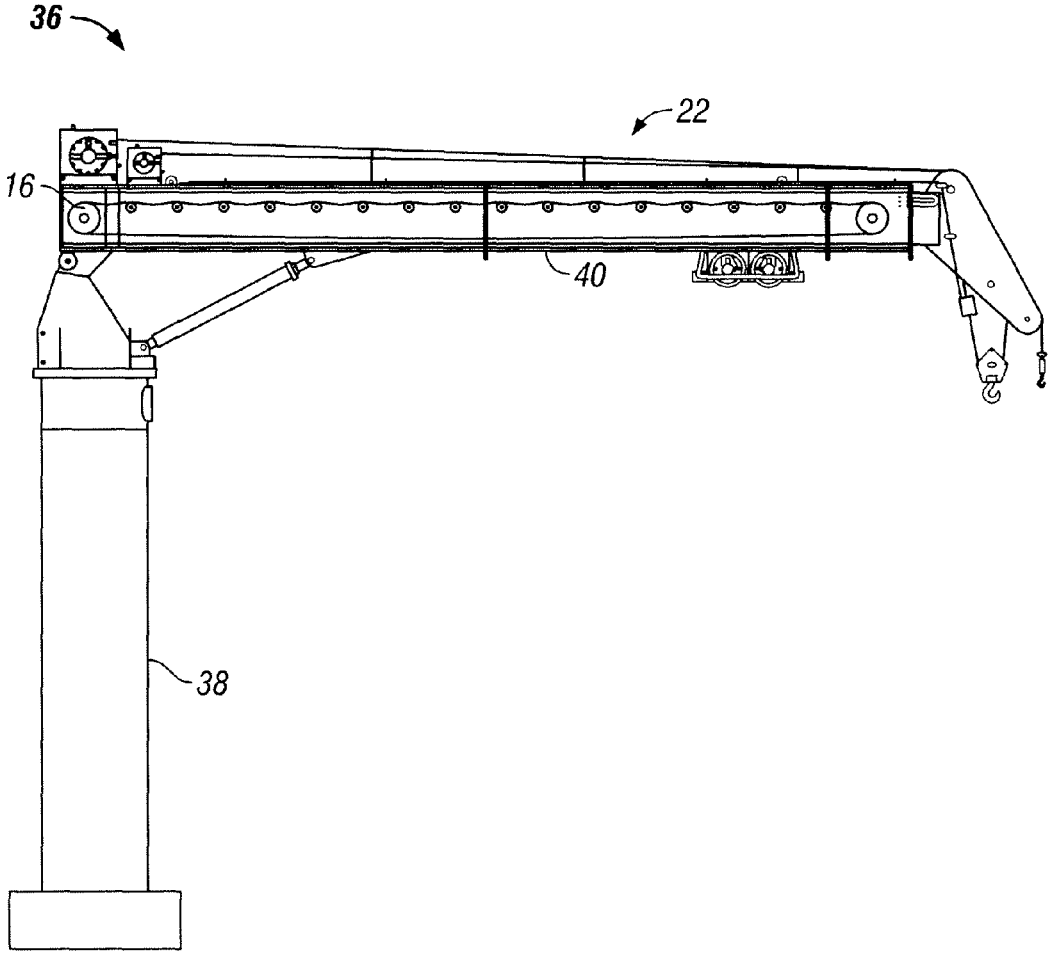
FIG. 3A is a cross-sectional side view of a conveyor, in accordance with one embodiment of the present invention.
Figure 3B:
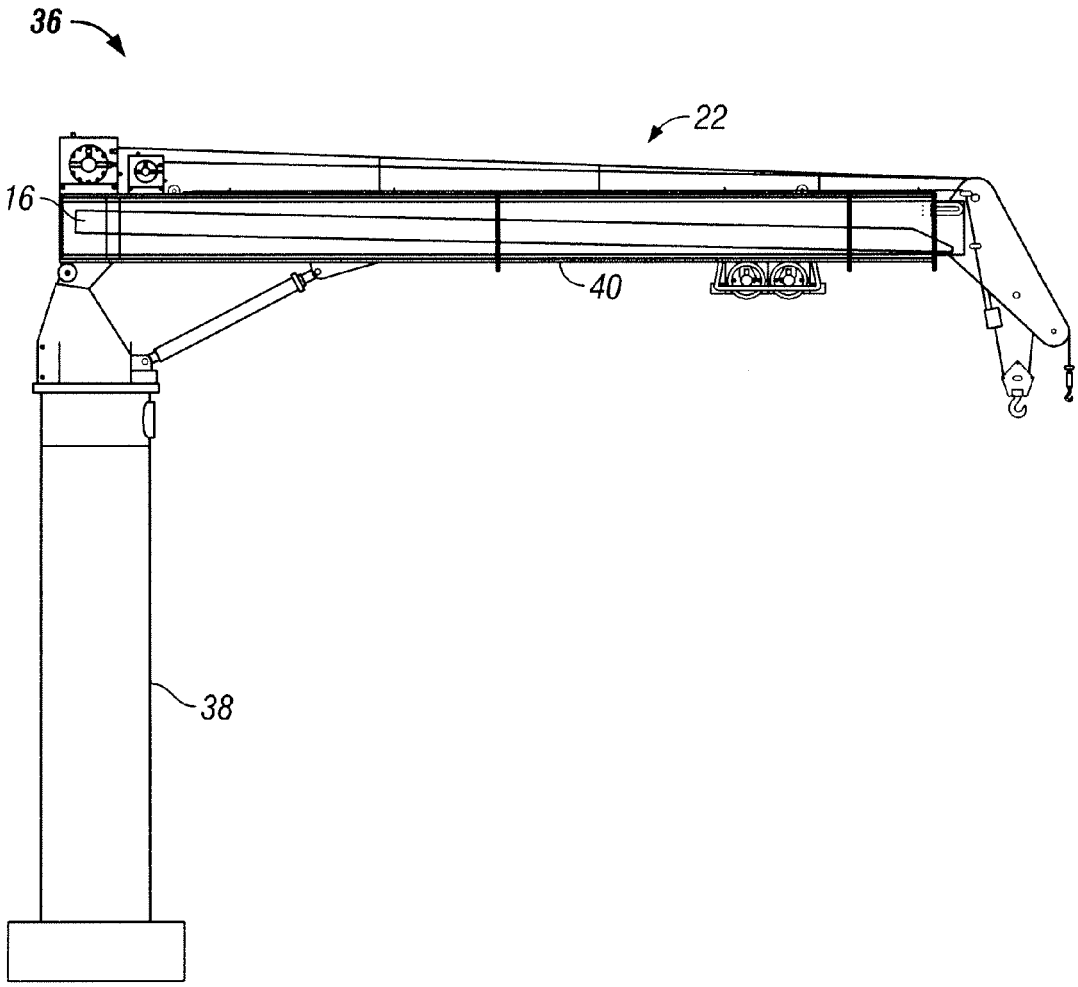
FIG. 3B is a cross-sectional side view of a conveyor, in accordance with another embodiment of the present invention.
Figure 3C:
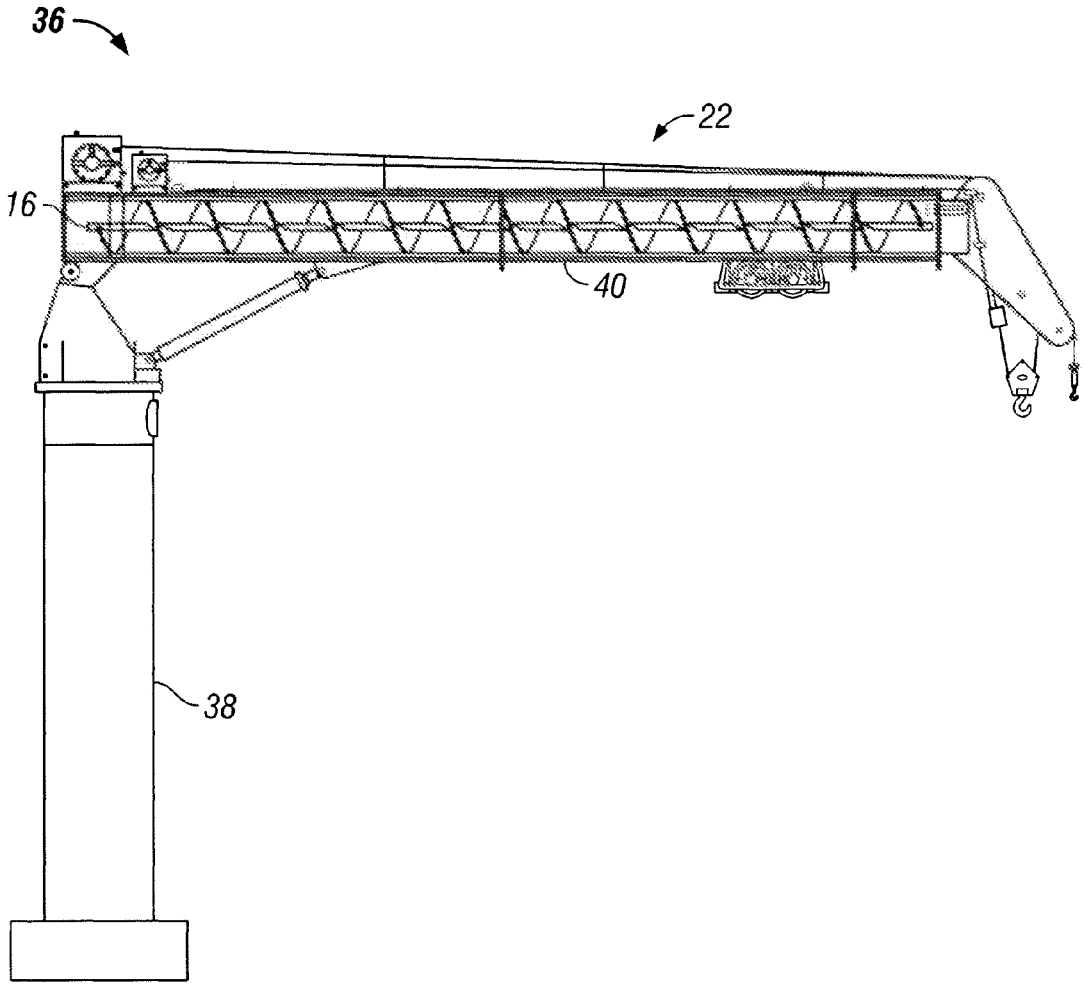
FIG. 3C is a cross-sectional side view of a conveyor, in accordance with yet another embodiment of the present invention.

Conduit 16 is illustrated as piping with a hose at each end, shown as hoses 17*a* and 17*b*, respectively, and dry material passing therethrough. However, as illustrated in FIGS. 3A, 3B, and 3C, respectively, conduit 16 instead may be a belt, with dry material passing thereon, chute with dry material passing therein, auger with dry material passing therethrough, or any other structure or structures for transporting dry material from first end 18 to second end 20. In some embodiments, conduit 16 provides one or more linear paths for dry material. In some embodiments, different types of structures may be used to form conduit 16. For example, conduit 16 may include a section of hose, which discharges to piping, which discharges to another section of hose. In another example, conduit 16 may include two connected sections of hose, which discharge to piping, which discharges to a belt, which discharges onto a chute. Depending on the particular embodiment, conduit 16 may be configured for attachment and/or communication with support 22, conveyor 24, and/or second vessel 14.

Support 22 is illustrated as crane 36 having substantially vertical mast 38 and substantially horizontal boom 40, supporting conduit 16 thereon. However, mast 38 and boom 40 may be angled or otherwise oriented. Likewise, mast 38 and boom 40 may not form crane 36, but may instead form another structure.

Figure 4:
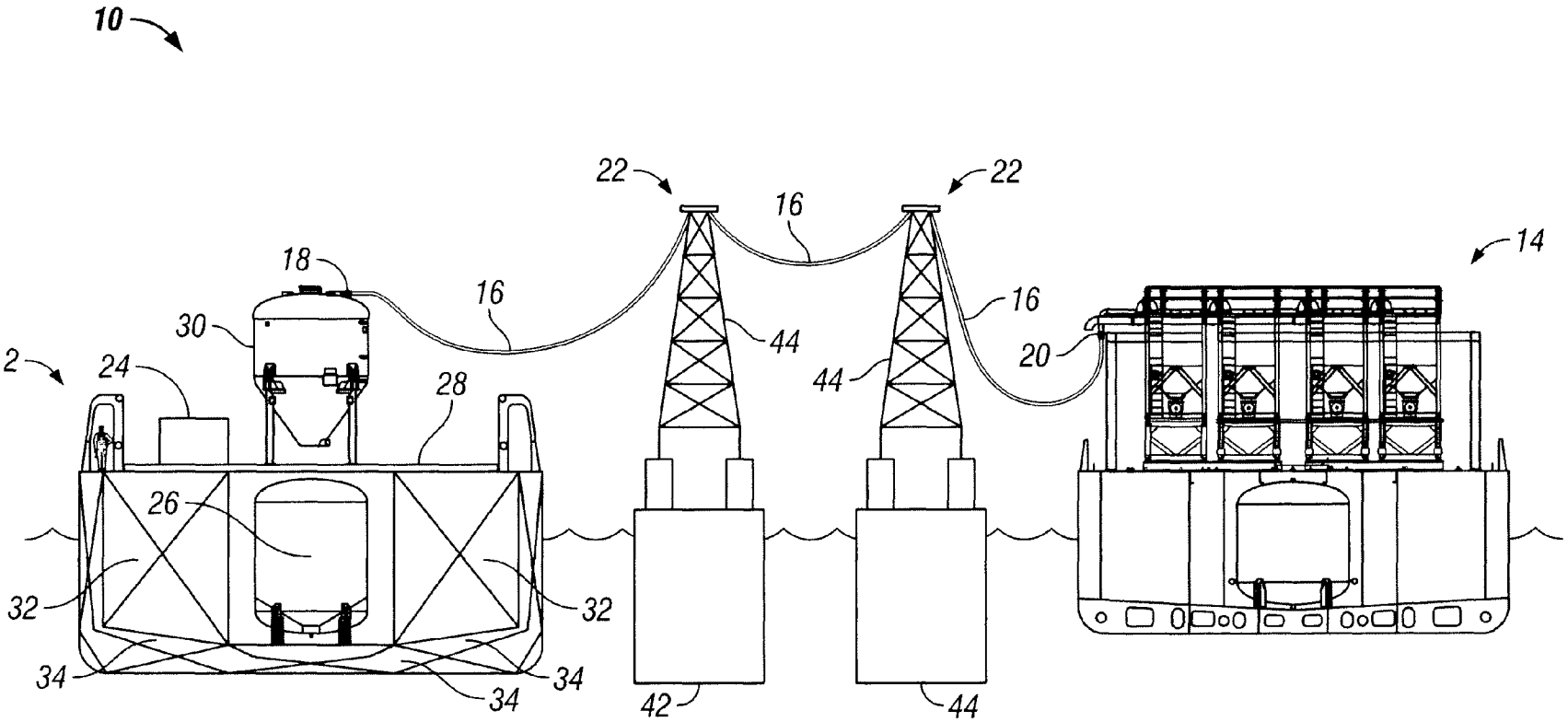
FIG. 4 is a cross-sectional side view of a transfer system, in accordance with an embodiment of the present invention.

As illustrated in FIG. 4, in some embodiments, support 22 may alternatively be floating support 42 with tower 44 or other elevating structures to contact conduit 16. Floating support 42 may support conduit 16 above floats as illustrated. Alternatively, floating support 42 may include loops or other connectors supporting conduit 16 from below. In some embodiments, conduit may be suspended below the floats. Floats may be at least partially constructed of Styrofoam, wood, metal with air voids, and/or any other material useful for supporting conduit 16 above or in water.

Referring back to FIGS. 1 and 2, conveyor 24 is illustrated as a set of air compressors on deck 28 of floating vessel 12. Three pumps on floating vessel 12 may be pressurized to provide pneumatic power. However, conveyor 24 may include fewer air compressors, other pneumatic energy sources, a belt, bucket elevator, auger, or any other device configured to move dry material from one location to another. Conveyor 24 may move dry material from dry bulk 26, other storage tank or other location to conduit 16 (e.g. at or near first end 18 or near an end of boom 40 proximate mast 38). Dry bulk 26 may be under deck 28 of floating vessel 12, as illustrated in FIG. 1. Alternatively, or additionally, at least one storage tank may be provided elsewhere in the vicinity of floating vessel 12. Conveyor 24 may be configured to move dry material vertically and/or horizontally, depending on the location of the storage tank and on the configuration of conveyor 24. In alternative embodiments, conveyor 24 may include a vacuum in communication with second end 20 or other remote portion of conduit 16.

Transfer system 10, including conduit 16, support 22, and conveyor 24 may be dispatched to a desired location via floating vessel 12 configured to transport dry material. For example, it may be desirable to transfer dry materials from shore or other loading location to a platform, well stimulation vessel, jack up rig, drilling vessel, or any other second vessel 14. For example, second vessel 14 may be provided to receive dry material for use in a wellbore operation, such as fracturing or other stimulation operation, drilling, cementing, and/or other operations in a wellbore.

Once floating vessel 12, complete with conduit 16, support 22, and conveyor 24 has arrived at second vessel 14, second end 20 of conduit 16 may be placed proximate second vessel 14 to transfer dry material from floating vessel 12 to second vessel 14. Support 22 may hold second end 20 of conduit 16 in a desired position relative to first end 18. The desired position may include a particular distance between floating vessel 12 and second vessel 14, and/or a particular bearing or heading, or it may simply be any position where second end 20 of conduit 16 is generally remote from first end 18 and/or floating vessel 12.

When support 22 includes boom 40 and mast 38, a remote end of boom 40 may be positioned vertically, horizontally, or both, relative to an end of boom 40 proximate mast 38 of crane 36. Thus, placing second end 20 of conduit 16 proximate second vessel 14 may involve aligning boom 40 in a particular direction, both horizontally and vertically. In some embodiments, boom 40 may rotate about mast 38, allowing the distance between second end 20 of conduit 16 and second vessel 14 to be maintained at a predetermined value. Likewise, boom 40 may pivot to allow for vertical adjustments. Boom 40 may also be configured to extend and/or contract to provide adjustments in position. Any positioning may occur manually, or with the assistance of computers, global positioning systems, or other devices. Thus, the relative position of second end 20 of conduit 16 relative to second vessel 14 may be substantially maintained, despite minor shifts between floating vessel 12 and second vessel 14 (e.g., vertical differences caused by waves and/or horizontal differences caused by drifting of vessels). In some embodiments, the height of boom 40 may be higher than the height of delivery point 19 (e.g., port, receptacle, etc.) of second vessel 14. Such an arrangement may produce a potential to help assist in transfer of dry material and, in some instances, accommodating the hose 17*b* (FIG. 1) or other flexible connector forming a flexible connection between floating vessel 12 and second vessel 14.

When support 22 includes a floating support, the floating support may be positioned horizontally, and in some embodiments, vertical adjustments may be made. Conduit 16 may be placed in engagement with the floating support, with first end 18 of conduit 16 proximate floating vessel 12 and second end 20 of conduit 16 remote from floating vessel 12.

Whatever the type of support 22, placement of second end of conduit 16 may include attaching second end 20 of conduit 16 to delivery point 19 (e.g., port, receptacle, etc.) of second vessel 14. Such an arrangement may be useful when conduit 16 includes piping and/or a flexible connector. When conduit 16 includes piping, attaching second end 20 of conduit 16 to second vessel 14 may be simplified with the use of the hose 17*b* (FIG. 1) or other flexible connector to provide a flexible connector between the piping and second vessel 14. Such flexibility may provide some compensation for elevation differences (i.e., heave) and/or horizontal movement (i.e., drift)

between floating vessel 12 and second vessel 14. Alternatively, placement may be accomplished without contact between conduit 16 and second vessel 14. For example, second end 20 of conduit 16 may be placed at a point in space above a desired container or other delivery point 19 of second vessel 14. Other configurations may be used to place second end 20 of conduit 16 proximate second vessel 14, so long as dry material can move from conduit 16 to second vessel 14.

Once conduit 16 is placed in a desired position, dry material may be transferred from floating vessel 12 to first end 18 of conduit 16. Conveyor 24 may be actuated to provide dry material to first end 18 of conduit 16 from one or more storage tanks (e.g., bulk tank 30) or other dry material source on floating vessel 12. Conveyor 24 may move dry material vertically, horizontally, or both. In some instances, conduit 16 includes a hose to connect conveyor 24 to a proximate end of piping on boom 40. Conduit 16 may then be allowed to transfer dry material from first end 18 to second end 20. The energy from conveyor 24 may cause dry material to move from first end 18 to second end 20. Alternatively, or additionally, gravity may assist in transfer of dry material from first end 18 to second end 20. When conduit 16 includes a belt, dry material may move from first end 18 to second end 20 when the belt is activated. Such activation may include turning a motor in communication with the belt to an "on" position or otherwise causing the belt to move dry material from one location to another.

Second vessel 14 receives dry material as it moves past second end 20 of conduit 16. Once second vessel 14 has received dry material, a downhole operation may be conducted using the dry material. For example, fracturing or other stimulation operations, drilling, cementing, and/or any other wellbore operation in which dry material may be used. Second vessel 14 may perform functions similar to well stimulation processes on land. Such processes may include hydraulic fracturing and acidizing to enhance the oil or gas well production. Also, some well stimulation vessels perform cementing operations. Second vessel 14 may additionally include a chemical processing function and operation center function.

In one particular embodiment, a workboat and a stimulation boat may be positioned with a predetermined distance between a mast of a rotating tower on the workboat and a receiving connection on the stimulation boat. A flexible connector may be connected to a discharge of a conveyance system on the workboat. A horizontal boom of the rotating tower may be rotated toward the stimulation boat to a position where the flexible connector is near the receiving connection point. The end of the flexible connector may be connected to the receiving connection on the stimulation boat. While connected, the workboat and the stimulation boat may maintain relative position within a predetermined operational envelope. Proppant may be transferred between the workboat and the stimulation boat by operating the conveyance system.

While dry material has been described as passing from floating vessel 12 to second vessel 14 via conduit 16, this is not intended to be limiting. Rather, any of a number of different materials may be transported via conduit 16. Additionally, multiple conduits 16 may be used to transport different materials at the same time, and a particular conduit may be used to transfer different materials at different times or simultaneously, depending on the operation. Thus, two different dry materials (e.g., proppants of different compositions), two different wet materials, or a wet material and a dry material may each be transported simultaneously where two conduits 16 are present. Additionally, multiple conduits 16 may be used to transport the same material at the same time, when offloading of that material in an expedient manner is desired. Additional conduits 16 may be provided, to support any number of different configurations.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. In addition, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A transfer system comprising:

a conduit having a first end and a second end, and being configured to transfer dry material from the first end to the second end;

a crane in contact with at least a portion of the conduit and including a boom, the crane being configured to maintain the second end of the conduit in a desired position relative to the first end of the conduit during transfer of the dry material from the first end to the second end;

a flexible hose coupled to the second end; and a conveyor adjacent the conduit, the conveyor being configured to deliver the dry material to the first end of the conduit from a floating vessel configured to transport the dry material, wherein the conveyor is a device selected from the group consisting of a pneumatic energy source and a vacuum system, or a combination thereof, wherein the second end of the conduit is configured for placement proximate a stimulation vessel and further configured for attachment to the stimulation vessel via the flexible hose.

2. The transfer system of claim 1, wherein the conduit comprises piping.

3. A transfer system comprising:

a workboat;

a conduit having a first end and a second end, and being configured to transfer dry material from the first end to the second end, wherein the first end is configured for placement proximate the workboat, and wherein the second end is configured for placement remote from the workboat;

a crane in contact with at least a portion of the conduit, the crane being configured to maintain the second end of the conduit in a desired position relative to the first end of the conduit during transfer of the dry material from the workboat via the conduit;

a flexible hose coupled to the second end; and a conveyor adjacent the conduit, the conveyor being configured to deliver the dry material to the first end of the conduit from a container configured to store the dry material on the workboat, wherein the conveyor is a device selected from the group consisting of a pneumatic energy source and a vacuum system, or a combination thereof, wherein the second end of the conduit is configured for placement proximate a stimulation boat and further configured for attachment to the stimulation boat via the flexible hose.

4. The transfer system of claim 3, wherein the conduit comprises piping.

5. A method of transferring dry material comprising:

providing a transfer system for a floating vessel comprising:

a conduit having a first end and a second end, and being configured to transfer the dry material from the first end to the second end;

a support crane in contact with at least a portion of the conduit, the crane being configured to maintain the second end of the conduit in a desired position relative to the first end of the conduit during transfer of the dry material from the first end to the second end;

a flexible hose coupled to the second end; and a conveyor adjacent the conduit and being a device selected from the group consisting of a pneumatic energy source and a vacuum system, or a combination thereof;

placing the floating vessel proximate a stimulation vessel:

placing the floating vessel proximate a stimulation vessel;

aligning the boom in a direction and connecting the second end of the conduit to a delivery point of the stimulation vessel via the flexible hose;

compensating for heave and drift between the floating vessel and the stimulation vessel with the flexible hose:

drawing the dry material from a container arranged on a floating vessel with the conveyor;

transferring the dry material from the floating vessel, via the conveyer to the first end of the conduit; and transferring the dry material from the first end to the second end with the conveyor; and conducting a downhole operation using the dry material.

6. The method of claim 5, further comprising moving the dry material horizontally with the conveyor.

7. The method of claim 5, wherein the second end of the conduit is configured for placement proximate a second vessel, the method comprising providing the second vessel and receiving the dry material with the second vessel.

* * * * *